US007266334B2

(12) United States Patent
Seorl et al.

(10) Patent No.: US 7,266,334 B2
(45) Date of Patent: Sep. 4, 2007

(54) COOLING UNIT FOR COOLING AN INTERMEDIATE TRANSFER MEDIUM OF AN IMAGE FORMING APPARATUS

(75) Inventors: Kwoang-joe Seorl, Suwon-si (KR); Sung-dae Kim, Suwon-si (KR); Young-joon Lee, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 59 days.

(21) Appl. No.: 11/154,529

(22) Filed: Jun. 17, 2005

(65) Prior Publication Data

US 2006/0127141 A1 Jun. 15, 2006

(30) Foreign Application Priority Data

Dec. 14, 2004 (KR) ..... 10-2004-0105321

(51) Int. Cl.
*G03G 15/16* (2006.01)
*G03G 15/20* (2006.01)
*G03G 21/20* (2006.01)

(52) U.S. Cl. ..... 399/307; 399/94

(58) Field of Classification Search ..... 399/94, 399/251, 302, 307, 308
See application file for complete search history.

(56) References Cited

U.S. PATENT DOCUMENTS 5,574,547 A * 11/1996 Denton et al. ..... 399/251
6,259,880 B1 * 7/2001 Jia et al. ..... 399/307
6,393,245 B1 * 5/2002 Jia et al. ..... 399/307
6,577,836 B2 * 6/2003 Yamashita et al. ..... 399/307
6,625,415 B2 * 9/2003 Nakashima et al. ..... 399/302
6,741,825 B2 * 5/2004 Omata et al. ..... 399/308

FOREIGN PATENT DOCUMENTS

| | | |
|---|---|---|
| JP | 08-044220 | 2/1996 |
| JP | 09-258570 | 10/1997 |
| JP | 2000-158635 | 6/2000 |
| JP | 2001-022186 | 1/2001 |
| KR | 2001-111038 | 12/2001 |

* cited by examiner

*Primary Examiner*—Sandra L. Brase
(74) *Attorney, Agent, or Firm*—Roylance, Abrams, Berdo & Goodman, L.L.P.

(57) ABSTRACT

An image forming apparatus includes a photosensitive medium on which an image is formed. An intermediate transfer medium is disposed to contact the photosensitive medium and to rotate in a closed loop, and onto which the image formed on the photosensitive medium is transferred. A transferring and fusing unit is disposed to contact the intermediate transfer medium. The image formed on the intermediate transfer medium is transferred onto a printing paper and the transferred image is fused onto the printing paper. A cooling unit is disposed inside of the intermediate transfer medium to cool a backside of the intermediate transfer medium to in turn cool the intermediate transfer medium.

17 Claims, 4 Drawing Sheets

COOLING UNIT FOR COOLING AN INTERMEDIATE TRANSFER MEDIUM OF AN IMAGE FORMING APPARATUS

CROSS-REFERENCE TO RELATED APPLICATIONS

This application claims the benefit under 35 U.S.C. § 119(a) of Korean Patent Application No. 2004-105321 filed on Dec. 14, 2004 in the Korean Intellectual Property Office, the entire disclosure of which is hereby incorporated by reference.

BACKGROUND OF THE INVENTION

1. Field of the Invention

The present invention is directed to an image forming apparatus. More particularly, the present invention is related to an image forming apparatus having a cooling unit for cooling an intermediate transfer medium.

2. Description of the Related Art

Generally, an electrophotographic image forming apparatus develops a predetermined electrostatic latent image formed on a photosensitive medium into a visible image, and then transfers the visible image onto a printing paper. More particularly, a wet electrophotographic image forming apparatus transfers and superposes each of a plurality of visible images formed on a plurality of photosensitive media onto an intermediate transfer medium to form a full color image, and then transfers the full color image onto the printing paper. The intermediate transfer medium may include an intermediate transfer belt, intermediate transfer drum, and so on. The image transferred onto the printing paper from either of the photosensitive media and the intermediate transfer medium is fixed thereon by high temperature and high pressure to keep the image in a transferred shape. To keep a life span or a performance of the photosensitive medium, there is a need to prevent heat of a fusing unit from heating the photosensitive medium over a predetermined temperature.

FIG. 1 shows an example of a conventional wet electrophotographic image forming apparatus having an intermediate transfer drum. The image forming apparatus cools a photosensitive medium to prevent the photosensitive medium from being heated over a predetermined temperature.

Referring to FIG. 1, the image forming apparatus includes an intermediate transfer medium 10, a photosensitive medium 20, a developing roller 30, and an ink supply unit 40.

The intermediate transfer medium 10 is drum-shaped and disposed to be in contact with the photosensitive medium 20. It transfers the image transferred from the photosensitive medium 20 onto a printing paper P.

The photosensitive medium 20 is drum-shaped and disposed to be in contact with the intermediate transfer medium 10. A used-ink cleaner 21, a charge eliminating unit 22, and a charging unit 23 are disposed on an outer circumference of the photosensitive medium 20 in a rotating direction thereof from a place where the photosensitive medium 20 is in contact with the intermediate transfer medium 10.

The developing roller 30 is disposed to be in contact with the photosensitive medium 20 in front of the charging unit 23 in a rotating direction of the photosensitive medium 20. It develops the electrostatic latent image formed on the photosensitive medium 20 into a visible image with ink being supplied by the ink supply unit 40.

There is an exposed space between the charging unit 23 and the developing roller 30. A laser beam scanned by a laser-scanning unit 24 irradiates the photosensitive medium 20 in the exposed space. An ink nozzle 41, which supplies the ink from the ink supply unit 40, is provided between the exposed space and the developing roller 30.

The ink supply unit 40 has a predetermined store of ink and supplies the ink for a nip between the developing roller 30 and the photosensitive medium 20 through the ink nozzle 41. Also, the ink supply unit 40 further includes an ink-cooling part (not shown) to keep the ink at a predetermined temperature.

The operation of the image forming apparatus having the aforementioned structure is explained hereinafter.

When the photosensitive medium 20 rotates according to a printing order, used ink remaining on the photosensitive medium 20 is removed by the used-ink cleaner 21, and a residual charge on a surface of the photosensitive medium 20 is eliminated by the charge eliminating unit 22. The surface of the photosensitive medium 20 is charged by the charging unit 23, and is exposed to a laser beam scanned by the laser-scanning unit 24, thereby forming an electrostatic latent image in a pattern corresponding to a printing data. The photosensitive medium 20 keeps rotating, and the electrostatic latent image is developed into a visible image by the ink supplied by the ink supply unit 40 and the developing roller 30. The visible image formed on the photosensitive medium 20 is transferred onto the intermediate transfer drum 10, which rotates and is in contact with the photosensitive medium 20. The image transferred to the intermediate transfer drum 10 is transferred onto the printing paper P and fixed thereon. The intermediate transfer drum 10 is heated since a predetermined heat is applied to the printing paper P when the image is transferred from the intermediate transfer drum 10 onto the printing paper P and fused thereon. As the intermediate transfer drum 10 is heated, the photosensitive medium 20, which rotates and is in contact with the intermediate transfer drum 10, is heated. When the photosensitive medium 20 is heated over a predetermined temperature, the life span of the photosensitive medium 20 may decrease and performance thereof may deteriorate. However, the photosensitive medium 20 of the image forming apparatus heated by the intermediate transfer drum 10 is cooled by the ink, since the image forming apparatus has the ink supply unit 40 that supplies ink at a predetermined temperature between the photosensitive medium 20 and the developing roller 30. Therefore, the photosensitive medium 20 is kept below a predetermined temperature. However, a method that directly cools the photosensitive medium 20 with the cooling ink repeatedly heats up and cools down the photosensitive medium 20, thereby causing heat fatigue of the photosensitive medium 20. The heat fatigue may shorten the life span thereof.

Also, when the intermediate transfer belt is used as the intermediate transfer medium 10, a front side of the intermediate transfer belt is generally cooled. However, when a coolant directly cools the front side of the intermediate transfer belt, used ink remaining on the intermediate transfer belt after the transfer contaminates the coolant. Therefore, there is a need to periodically change the coolant. Also, when the coolant is not completely removed from the front side of the photosensitive medium belt, a residual coolant thereof can contaminate the ink. Thus, the image transferred from the photosensitive medium to the intermediate transfer belt may be deteriorated.

Accordingly, a need exists for an image forming apparatus that cools an intermediate transfer medium to substantially prevent overheating of a photosensitive medium.

SUMMARY OF THE INVENTION

An exemplary aspect of the present invention provides an image forming apparatus cooling an intermediate transfer medium for substantially preventing a photosensitive medium from being heated.

Another aspect of the present invention provides an image forming apparatus using various types of coolant without being limited due to concern for contamination of the intermediate transfer belt since the coolant cools a backside of the intermediate transfer belt.

Still another aspect of the present invention is to provide an image forming apparatus substantially preventing residual coolant of an intermediate transfer medium from deteriorating an image transferred from the photosensitive medium to the intermediate transfer medium because the coolant cools a backside of the intermediate transfer belt, thereby leaving substantially no residual coolant on a front side thereof.

An image forming apparatus includes a photosensitive medium on which an image is formed. An intermediate transfer medium is disposed to contact the photosensitive medium and to rotate in a closed loop, and onto which the image formed on the photosensitive medium is transferred. A transferring and fusing unit is disposed to contact the intermediate transfer medium, thereby transferring the image formed on the intermediate transfer medium onto a printing paper and fusing the transferred image onto the printing paper. A cooling unit is disposed inside the intermediate transfer medium, thereby making coolant directly in contact with a backside of the intermediate transfer medium to cool down the intermediate transfer medium.

The cooling unit includes a spray part spraying the coolant to the backside of the intermediate transfer medium. A collection part collects the coolant sprayed from the spray part. A cooler cools down the coolant by a predetermined temperature.

Preferably, the cooler includes a refrigerating cycle having a compressor, a condenser, and a vaporizer.

The cooler unit may further include a removing blade disposed to contact the backside of the intermediate transfer medium to remove the coolant attached on the backside thereof.

The cooling unit may further include a temperature sensor sensing temperature of the coolant, and a cooling controller operating the cooling unit when the coolant temperature sensed by the temperature sensor is over a predetermined temperature.

The image forming apparatus may further include a dry unit disposed between the photosensitive medium and the transferring and fusing unit to dry the image formed on the intermediate transfer medium.

According to another aspect of the present invention, an image forming apparatus includes a photosensitive medium on which an image is formed. An intermediate transfer medium is disposed to contact the photosensitive medium and to rotate in a closed loop, and onto which the image formed on the photosensitive medium is transferred. A transferring and fusing unit is disposed to contact the intermediate transfer medium to transfer the image formed on the intermediate transfer medium onto a printing paper and fusing the transferred image onto the printing paper. A cooling unit is disposed to contact a backside of the intermediate transfer medium, and has a cooling member that circulates coolant inside of the intermediate transfer medium.

The cooling unit includes a circulating pump circulating the coolant through the cooling member. A cooler cools the coolant to a predetermined temperature. The cooler has a refrigerating cycle having a compressor, a condenser, and a vaporizer.

The cooling unit may further include a temperature sensor sensing temperature of the coolant, and a cooling controller operating the cooling unit when the coolant temperature sensed by the temperature sensor is over a predetermined temperature.

In an image forming apparatus according to exemplary embodiments of the present invention described above, the cooling unit cools the intermediate transfer medium so that the photosensitive medium is not heated. Therefore, an image forming apparatus is provided that does not substantially shorten a lifespan of the photosensitive medium and does not substantially deteriorate performance thereof.

In an image forming apparatus according to exemplary embodiments of the present invention, the cooling unit cools a backside of the intermediate transfer medium so that the coolant does not contaminate the ink. Therefore, an image forming apparatus is provided that may use various types of coolant.

An image forming apparatus according to exemplary embodiments of the present invention, the cooling unit cools an inside of the intermediate transfer medium so that residual coolant of the intermediate transfer medium does not deteriorate an image transferred from the photosensitive medium onto the intermediate transfer medium.

Other objects, advantages and salient features of the invention will become apparent from the following detailed description, which, taken in conjunction with the annexed drawings, discloses preferred embodiments of the invention.

BRIEF DESCRIPTION OF THE DRAWING FIGURES

These and other aspects and advantages of the invention will become apparent and more readily appreciated from the following description of the exemplary embodiments, taken in conjunction with the accompanying drawing figures of which:

Throughout the drawings, like reference numerals will be understood to refer to like parts, components and structures.

DETAILED DESCRIPTION OF EXEMPLARY EMBODIMENTS

Hereinafter, certain exemplary embodiments of the present invention are described in detail with reference to the accompanying drawing figures.

The matters defined in the description, such as a detailed construction and elements thereof, are provided to assist in a comprehensive understanding of the invention. Thus, it is apparent that the present invention may be carried out without those defined matters. Also, well-known functions or constructions are omitted to provide a clear and concise description of exemplary embodiments of the present invention.

Figure 1:
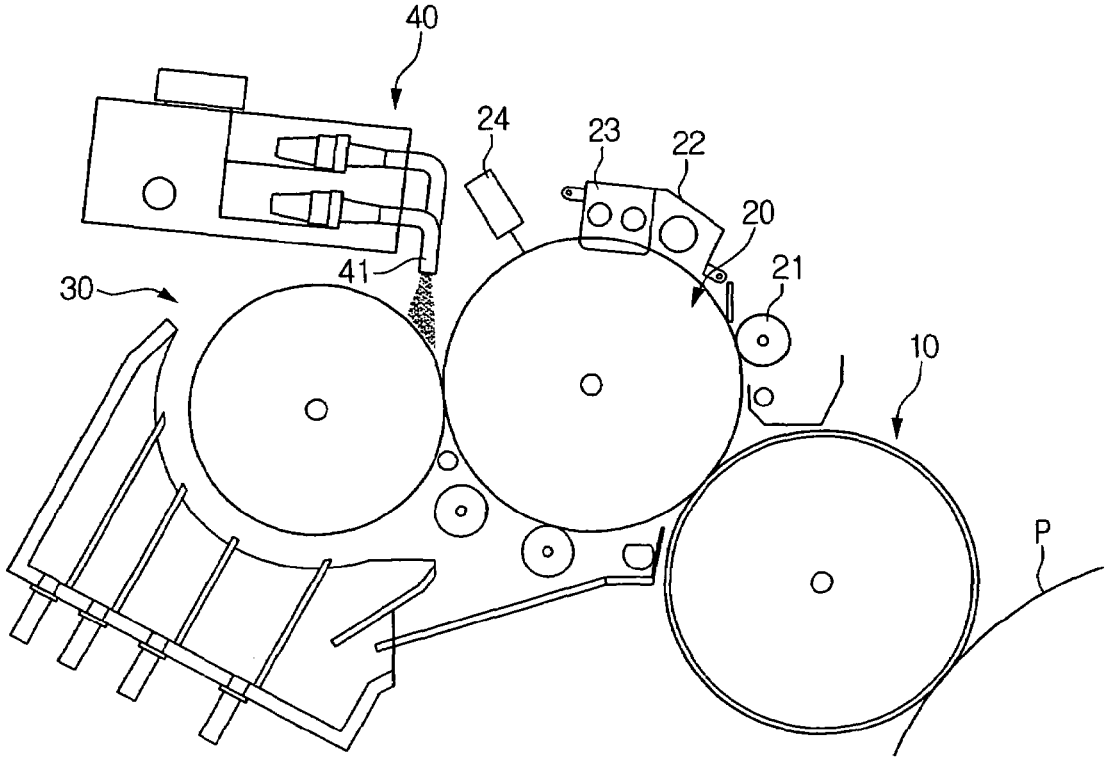
FIG. 1 (PRIOR ART)
FIG. 1 is a schematic view of a cooling method keeping a photosensitive medium of a conventional image forming apparatus at a predetermined temperature.
Figure 2:
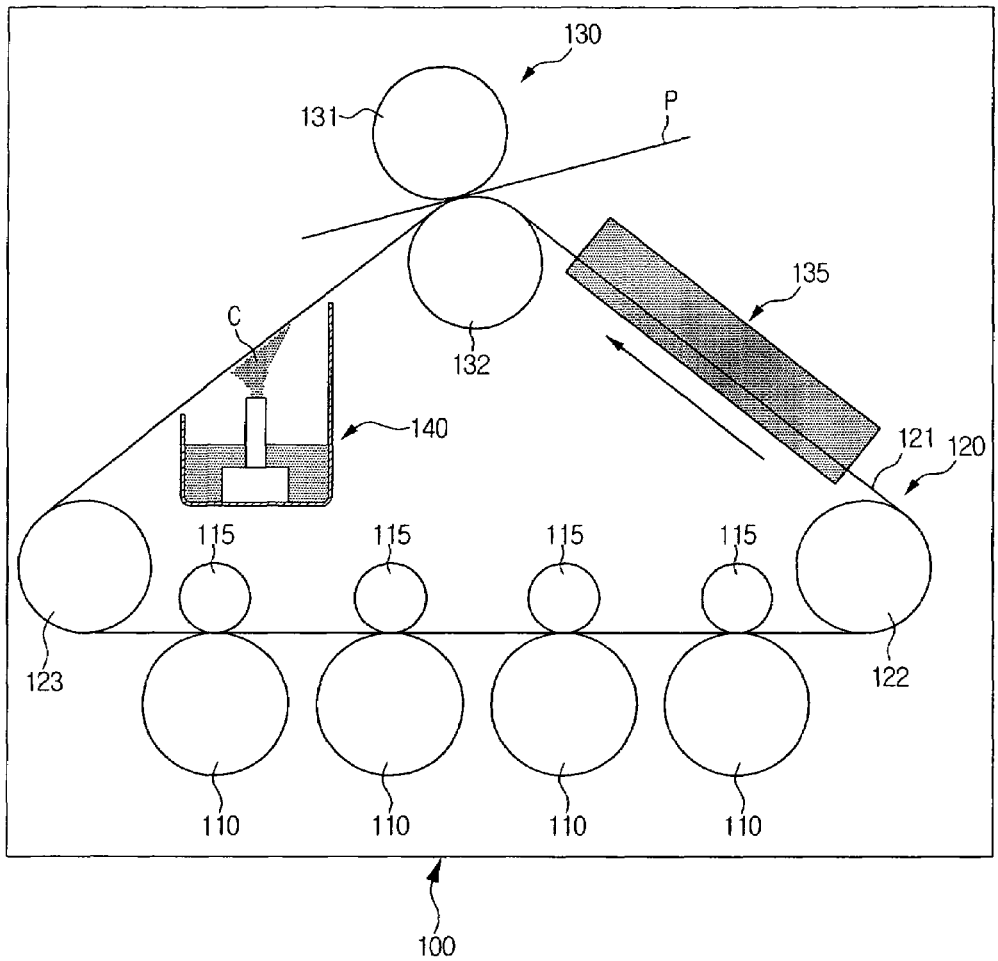
FIG. 2 is a schematic view of an image forming apparatus according to an exemplary embodiment of the present invention.
Figure 3:
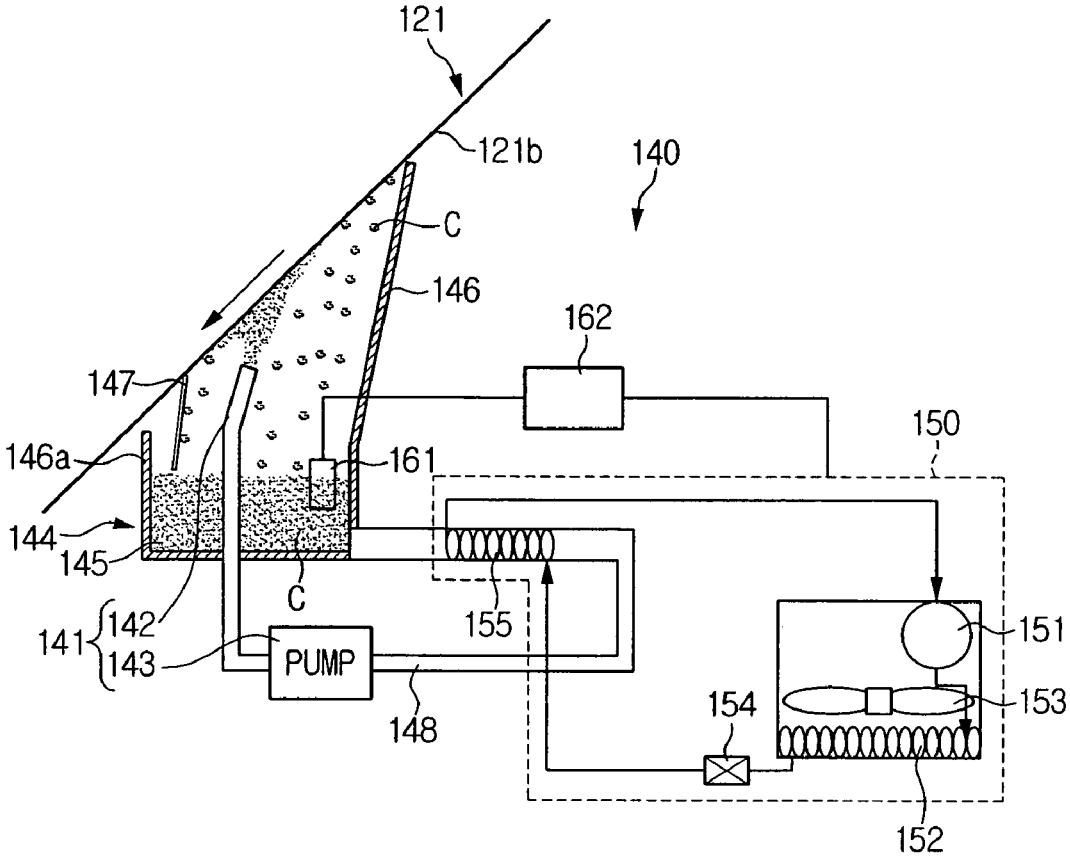
FIG. 3 is a schematic view of an exemplary embodiment of a cooling unit of the image forming apparatus of FIG. 2.

In FIGS. 2 and 3, general components of an image forming apparatus, such as a paper pickup unit, a paper feeding unit, a paper-discharging unit and so on, are omittedas those elements are conventional.

Referring to FIGS. 2 and 3, an image forming apparatus according to an exemplary embodiment of the present invention includes a photosensitive medium 110, an intermediate transfer medium 120, a transferring and fusing unit 130, and a cooling unit 140.

A predetermined electrostatic latent image is formed on the photosensitive medium 110 by a laser beam scanned by a laser-scanning unit (not shown). A charging unit (not shown) for charging the photosensitive medium 110 with a predetermined voltage, a developing unit (not shown) for developing the electrostatic latent image formed on the photosensitive medium 110 into a visible image, and a cleaning unit (not shown) for removing used ink remained on the photosensitive medium 110 after being transferred to the intermediate transfer medium 120 are disposed at an outer circumference of the photosensitive medium 110. One or more than one photosensitive media 110 may be used according to a type of printing color. For full color printing, an image forming apparatus according to an exemplary embodiment of the present embodiment includes four photosensitive media 110, as shown in FIG. 2. Each of the photosensitive media 110 is preferably used to form a black image, a cyan image, a magenta image, and a yellow image, respectively.

The image formed on the photosensitive medium 110 is transferred and superposed onto the intermediate transfer medium 120. The intermediate transfer medium 120 is disposed to be in contact with the four photosensitive media 110. An intermediate transfer belt 121 may be used as the intermediate transfer medium 120. The intermediate transfer belt 121 is supported and moved in a closed loop by a pair of pulleys 122 and 123. The intermediate transfer medium 120 according to an exemplary embodiment of the present embodiment includes an intermediate transfer belt 121, a driving pulley 122 and a driven pulley 123 causing the intermediate transfer belt 121 to move in a closed loop, and a roller 132 of a transferring and fusing unit 130 that transfers the image formed on the intermediate transfer belt 121 onto a printing paper P and fuses thereon. The roller 132 is disposed between the driving pulley 122 and the driven pulley 123. The four photosensitive media 110, on which black (B), cyan (C), magenta (M), yellow (Y) images are respectively formed, are linearly arranged on an outer surface of the intermediate transfer belt 121 in a traveling direction thereof. Also, four transfer backup rollers 115 are disposed in positions corresponding to the four photosensitive media 110 along an inner surface of the intermediate transfer belt 121.

The transferring and fusing unit 130 is disposed at an opposite side of the intermediate transfer belt 121 from the four photosensitive media 110. When transferring a full color image formed on the intermediate transfer belt 121 by the four photosensitive media 110 onto the printing paper P, the transferring and fusing unit 130 fuses the transferred full color image onto the printing paper P. The transferring and fusing unit 130 includes a pair of rollers 131 and 132. The pair of rollers 131 and 132 are a heating roller generating a predetermined heat and a pressing roller applying a predetermined force. Therefore, when transferring the image to be formed on the intermediate transfer belt 121 onto the printing paper P, the transferring and fusing unit 130 fuses the transferred image on the printing paper P by applying the heat of the heating roller and the force of the pressing roller. The heating roller may be disposed either above or below the intermediate transfer belt 121, and the pressing roller is disposed either above or below the intermediate transfer belt 121 to correspond to the heating roller. In the image forming apparatus according to an exemplary embodiment of the present embodiment as shown in FIG. 2, the heating roller 131 is disposed above the intermediate transfer belt 121 and the pressing roller 132 is disposed below the intermediate transfer belt 121.

Preferably, a drying unit 135 is disposed upstream of the transferring and fusing unit 130 (to the right side of the transferring and fusing unit in FIG. 2) to evaporate a liquid carrier of liquid ink forming an image transferred onto the intermediate transfer belt 121 by the photosensitive media 110.

The cooling unit 140 is disposed downstream of the transferring and fusing unit 130 (to the left side of the transferring and fusing unit in FIG. 2) inside the intermediate transfer belt 121 to cool the intermediate transfer belt 121, which is heated by the transferring and fusing unit 130 and the drying unit 135, by a predetermined temperature. When the heated intermediate transfer belt 121 is in contact with the photosensitive medium 110, the photosensitive medium 110 is heated, thereby shortening a lifespan thereof and deteriorating performance thereof. Therefore, there is a need that the intermediate transfer belt 121 is cooled before being in contact with the photosensitive medium 110. The cooling unit 140 allows coolant to be directly applied to a backside (inner surface) 121*b* of the intermediate transfer belt 121 to increase a cooling efficiency thereof, as shown in FIG. 3.

An example of the cooling unit 140 is shown in FIG. 3. Referring to FIG. 3, the cooling unit 140 includes a spray part 141 to spray coolant C, a collection part 144 collecting the coolant C that collides with the backside 121*b* of the intermediate transfer belt 121 and then drops down after being sprayed from the spray part 141, a cooler 150 cooling the coolant C below a predetermined temperature, a temperature sensor 161 sensing a temperature of the coolant C, and a cooling controller 162 controlling the cooler 150 to correspond to a coolant temperature.

The spray part 141 has a spray nozzle 142 through which the coolant C is sprayed and a spray pump 143 that projects the coolant C spray. As the position of the spray nozzle 142 is controlled, a spray angle and a spray distance of the coolant C to be sprayed toward the backside 121*b* of the intermediate transfer belt 121 are controlled. Also, a quantity of the spraying coolant C may be determined by a capacity of the spray pump 143.

The collection part 144 includes a coolant housing 145 holding a predetermined quantity of the coolant C and a blocking wall 146 extending from an upper end of the coolant housing 145. The blocking wall 146 prevents the coolant C sprayed from the spray nozzle 142 from spattering to outside of the coolant housing 145. The blocking wall 146 is formed to not cause friction against the backside 121*b* of the intermediate transfer belt 121 and to prevent the sprayed coolant C from spattering outside of the coolant housing 145. Preferably, an upper end of a blocking wall 146*a* is located downstream of the spray nozzle 142 (to the left side of the spray nozzle in FIG. 3) is formed as a blade to remove the coolant C attached on the backside 121*b* of the intermediate transfer belt 121. A removing blade 147 may be disposed downstream of the spray nozzle 142 to effectively remove the coolant C attached on the backside 121*b* of the intermediate transfer belt 121, as shown in FIG. 3. A coolant pipe 148 provided at the bottom of the coolant housing 145 is fluidly connected with the spray pump 143 such that the spray pump 143 sprays the coolant C collected in the coolant housing 145.

The cooler 150 cools the coolant C below a predetermined temperature, and may be applied to all types of cooling apparatuses. Preferably, the cooler 150 is applied as a refrigerating cycle that cools the coolant C by refrigerant. The refrigerating cycle used in the cooling unit 140 according to an exemplary embodiment of the present invention includes a compressor 151, a condenser 152, and a vaporizer 155. The compressor 151 compresses a refrigerant gas of low temperature and low pressure evaporated in the vaporizer 155. The condenser 152 condenses a refrigerant gas of high temperature and high pressure compressed in the compressor 151 into a refrigerant liquid. A fan 153 is used to liquefy the refrigerant gas. The refrigerant liquefied by the condenser 152 evaporates by adiabatic expansion while passing through an expansion valve 154. When the evaporated refrigerant gas of low temperature and low-pressure passes through the vaporizer 155, it exchanges heat with the coolant C, thereby cooling the coolant C to the predetermined temperature. The vaporizer 155 is formed in a tube-shaped member to increase an area in contact with the coolant C. Since the elements of the refrigerating cycle described above are similar to those of the conventional ark detailed explanation is omitted for the sake of brevity.

The temperature sensor 161 senses the temperature of the coolant C in the coolant housing 145 and transmits a signal to the cooling controller 162. The cooling controller 162 determines the temperature of the coolant C in the coolant housing 145 by the signal received from the temperature sensor 161. If the temperature of the coolant C is over the predetermined temperature, the cooling controller 162 operates the cooler 150 to cool the coolant C below the predetermined temperature.

The operation of the cooling unit 140 having the same structure as that described above to cool the coolant C below the predetermined temperature is explained hereinafter.

The temperature sensor 161, which is disposed in the coolant housing 145, senses the temperature of the coolant C in the coolant housing 145 at regular intervals and transmits a temperature signal to the cooling controller 162. Then, the cooling controller 162 determines whether the temperature of the coolant C therein is over the predetermined temperature. When the coolant temperature is below the predetermined temperature, the cooling controller 162 keeps the cooler 150 inactive. When the coolant temperature is over the predetermined temperature, the cooling controller 162 operates the cooler 150 so that the refrigerant circulates through the compressor 151, the condenser 152, and the vaporizer 155. While the refrigerant circulates through the cooler 150, the coolant C passing through the coolant pipe 148 exchanges heat with the refrigerant in the vaporizer 155, thereby cooling the coolant. The cooled coolant C is sprayed by the spray pump 143 and collected in the coolant housing 145. The coolant C collected in the coolant housing 145 is cooled by the process described above. Then, the cooling controller 162, which senses the temperature of the coolant C in the coolant housing 145 through the temperature sensor 161, stops the cooler 150 when the coolant temperature is decreased below the predetermined temperature. Though the cooler 150 stops, the cooling unit 140 keeps cooling down the intermediate transfer belt 121 by the cooled coolant C. When the temperature of the coolant C collected in the coolant housing 145 is increased due to cooling down the intermediate transfer belt 121, the cooling controller 162, which senses the temperature of the coolant C in the coolant housing 145 through the temperature sensor 161, operates the cooler 150. Then, the cooler 150 cools the coolant C below the predetermined temperature as described above.

Figure 4:
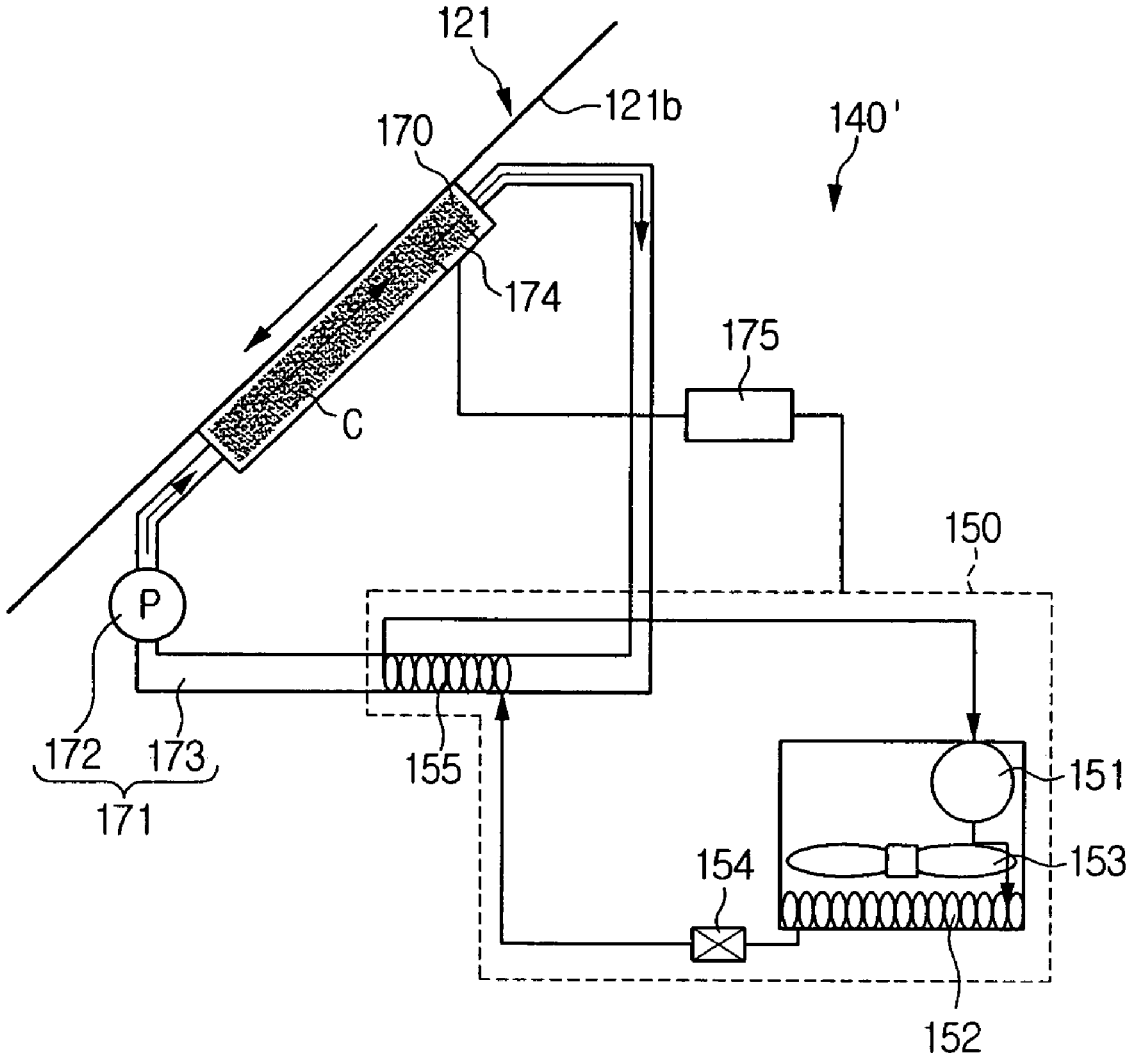
FIG. 4 is a schematic view of another exemplary embodiment of a cooling unit of the image forming apparatus according to the present invention.

FIG. 4 shows another exemplary embodiment of a cooling unit 140' of the image forming apparatus according to the present invention. Referring to FIG. 4, the cooling unit 140' includes a cooling member 170, a coolant circulating part 171, and a cooler 150.

The cooling member 170 is disposed to contact the backside (inner surface) 121*b* of the intermediate transfer belt 121, and to cool the intermediate transfer belt 121. A plurality of passages through which the coolant C flows are formed inside the cooling member 170. Therefore, the heat, which is conducted from the intermediate transfer belt 121 to the cooling member 170, is conducted to the coolant C circulating inside the cooling member 170.

The coolant circulating part 171 has a coolant-circulating pipe 173 that fluidly connects between a front end and a rear end of the cooling member 170, and a circulating pump 172 circulating the coolant C. The cooler 150 is disposed in the coolant-circulating pipe 173. The cooler 150 cools the coolant C circulating through the coolant-circulating pipe 173. A capacity of the circulating pump 172 is determined according to the amount of coolant C required to allow the cooling member 170 to cool the intermediate transfer belt 121 below a predetermined temperature.

The cooler 150 cools the coolant C, which absorbs heat from the intermediate transfer belt 121 while passing by or through the cooling member 170, below the predetermined temperature. The cooler 150 may use various types of cooling apparatuses. Preferably, the cooler 150 uses a refrigerating cycle, which cools the coolant C with a refrigerant. The refrigerating cycle used in the cooling unit 140' according to another exemplary embodiment of the present invention includes a compressor 151, a condenser 152, and a vaporizer 155. The refrigerating cycle is the same as that described above, and therefore, detailed description thereof is omitted.

The cooling unit 140' further includes a temperature sensor 174 that senses a temperature of the coolant C flowing through the cooling member 170, and a cooling controller 175 that controls the cooler 150 according to a signal from the temperature sensor 174. The temperature sensor 174 is disposed inside of the cooling member 170. The temperature sensor 174 senses a temperature of the coolant C circulating through the cooling member 170, and then sends a temperature signal to the cooling controller 175. The cooling controller 175 receives the signal from the temperature sensor 174, and determines the temperature of the coolant C circulating through the cooling member 170. When the coolant temperature is over the predetermined temperature, the cooling controller 175 operates the cooler 150 so that the cooler 150 cools the coolant C below the predetermined temperature.

The operation of the cooling unit according to another exemplary embodiment of the present invention having the aforementioned structure is explained hereinafter.

The temperature sensor 174 disposed inside the cooling member 170 senses the temperature of the coolant C passing through the cooling member 170 at predetermined time intervals, and then sends a temperature signal to the cooling controller 175. Then, the cooling controller 175 determines the temperature of the coolant C flowing through the cooling member 170. When the temperature of the coolant C is below the predetermined temperature, the cooling controller 175 keeps the cooler 150 inactive. When the temperature of the coolant C is over the predetermined temperature, the cooling controller 175 operates the cooler 150 so that the refrigerant circulates through the refrigerating cycle, which includes the compressor 151 and the condenser 152. While the refrigerant circulates through the cooler 150, the coolant C passing through the coolant-circulating pipe 173 exchanges heat with the refrigerant in the vaporizer 155, thereby cooling the coolant. The coolant C circulating through the cooling member 170 is cooled through the aforementioned process. When the temperature of the coolant C has been cooled below the predetermined temperature, the cooling controller 175 stops the cooler 150. Then, the coolant C that is cooled below the predetermined temperature exchanges heat with the intermediate transfer belt 121 such that the cooler 150 cools the intermediate transfer belt 121. When the coolant C flowing through the cooling member 170 is heated over the predetermined temperature due to continuous heat exchange with the intermediate transfer belt 121, the cooling controller 175, which senses the temperature of the coolant C by the temperature sensor 174, operates the cooler 150 as described above so that the coolant C is cooled below the predetermined temperature.

When the temperature sensor 174 is not disposed inside the cooling member 170, a cooling pump 172 of the cooling unit 140' allows the coolant C to circulate between the cooling member 170 and the vaporizer 155. While circulating, the coolant C is heated by absorbing heat from the intermediate transfer belt 121 while passing by or through the cooling member 170. Heated coolant C is cooled while passing through the vaporizer 155 of the cooler 150, which is disposed in the coolant-circulating pipe 173. The cooler 150 keeps operating regardless of the temperature of the coolant C, thereby cooling the coolant C passing through the vaporizer 155.

Referring to FIGS. 2 to 4, the operation of the image forming apparatus according to exemplary embodiments of the present invention is explained hereinafter.

When the image forming apparatus 100 receives a printing signal, a plurality of laser scanning units (not shown) scan laser beams on a plurality of corresponding photosensitive media 110 and forms electrostatic latent images corresponding with the printing data thereon. The electrostatic latent image transferred on the photosensitive medium 110 is developed into a predetermined color image by the developing unit (not shown), and then transferred onto the moving intermediate transfer belt 121. The color image on each of the four photosensitive media 110 is sequentially transferred and superposed onto the intermediate transfer belt 121, thereby forming a full color image.

Since the intermediate transfer belt 121 is rotated by the driving roller 122 and the driven roller 123, the full color image on the intermediate transfer belt 121 passes through the drying unit 135. When the intermediate transfer belt 121 is passing through the drying unit 135, the liquid carrier contained in the color image is vaporized by the heat of the drying unit 135, thereby leaving substantially only toner. The heat of the drying unit 135 heats the intermediate transfer belt 121.

When the intermediate transfer belt 121 keeps rotating, the full color image enters between a pair of rollers 131 and 132 of the transferring and fusing unit 130. A printing paper P is fed from the feeding unit (not shown) to enter between the pair of rollers 131 and 132 of the transferring and fusing unit 130. Therefore, the full color image on the intermediate transfer belt 121 is transferred onto the printing paper P and is fused on the printing paper P by the heat and the pressure of a heating roller 131 and a pressing roller 132 of the transferring and fusing unit 130. While the full color image is transferred onto the printing paper P from the intermediate transfer belt 121 and fused thereon, the heating roller 131 heats the intermediate transfer belt 121.

The intermediate transfer belt 121, which is heated by the high temperatures during passing through the drying unit 135 and the transferring and fusing unit 130, is cooled below the predetermined temperature during passing by or through the cooling unit 140. In the cooling unit 140 according to an exemplary embodiment as shown in FIG. 3, when the heated intermediate transfer belt 121 passes over an area that is surrounded by the blocking wall 146, the spray nozzle 142 sprays the coolant C on the backside (inner surface) 121*b* of the intermediate transfer belt 121, thereby cooling down the intermediate transfer belt 121. The coolant C is sprayed through the spray nozzle 142 by the spray pump 143. Therefore, the coolant C directly exchanges heat with the intermediate transfer belt 121, thereby cooling the intermediate transfer belt 121 below the predetermined temperature. The sprayed coolant C collides with the backside 121*b* of the intermediate transfer belt 121 and drops down, thereby being collected in the coolant housing 145. The blocking wall 146 blocks the coolant C scattered by collision with the intermediate transfer belt 121, thereby collecting the scattered coolant C in the coolant housing 145. The coolant C attached to the backside 121*b* of the intermediate transfer belt 121 is removed by the removing blade 147, which is disposed behind (downstream of) the spray nozzle 142, thereby being collected in the coolant housing 145. Therefore, coolant C is not moved between the photosensitive medium 110 and the transfer backup roller 115. When the coolant C is heated up over the predetermined temperature because of exchanging heat with the intermediate transfer belt 121, the cooler 150 operates and cools the coolant C below the predetermined temperature. The operation in which the cooler 150 cools the coolant C is not explained hereinafter since it was previously described above.

In the example of a cooling unit. 140' as shown in FIG. 4 according to another exemplary embodiment of the present invention, the backside (inner surface) 121*b* of the intermediate transfer belt 121 is in contact with the cooling member 170 and exchanges heat with the cooling member 170 so that the intermediate transfer belt 121 is cooled. The heat conducted to the cooling member 170 is conducted to the coolant C circulating inside of the cooling member 170. The coolant C, which absorbs the heat of the heated intermediate transfer belt 121, is cooled when passing through the vaporizer 155 of the cooler 150, and the cooled coolant is then supplied to the cooling member 170. The operation in which the cooler 150 cools the coolant C is not explained hereinafter since it was previously described above. Since the intermediate transfer belt 121 is cooled by the process described above, it enters the photosensitive medium 110 cooled below the predetermined temperature. Therefore, the heat of the intermediate transfer belt 121 does not influence the photosensitive medium 110 such that the lifespan thereof is substantially not shortened and the performance thereof is substantially not deteriorated.

The printing paper P, onto which the image is transferred and fused, is discharged outside of the image forming apparatus 100 by a discharging unit (not shown).

While the embodiments of the present invention have been described, additional variations and modifications of the embodiments may occur to those skilled in the art once they learn of the basic inventive concepts. Therefore, it is intended that the appended claims shall be construed to include both the above exemplary embodiments and all such variations and modifications that fall within the spirit and scope of the invention.

What is claimed is:

1. An image forming apparatus, comprising:

a photosensitive medium on which an image is formed;

an intermediate transfer medium disposed to contact the photosensitive medium and to rotate in a closed loop, and onto which the image formed on the photosensitive medium is transferred;

a transferring and fusing unit disposed to contact the intermediate transfer medium to transfer the image formed on the intermediate transfer medium onto a printing paper and to fuse the transferred image onto the printing paper; and a cooling unit disposed inside of the intermediate transfer medium to bring a liquid coolant into direct contact with a backside of the intermediate transfer medium to cool the intermediate transfer medium.

2. The image forming apparatus of claim 1, wherein a spray part of the cooling unit sprays the liquid coolant to the backside of the intermediate transfer medium;

a collection part collects the liquid coolant sprayed from the spray part; and a cooler cools the liquid coolant to a predetermined temperature.

3. The image forming apparatus of claim 2, wherein a wall of the collection part extends upstream of the spray part to prevent spraying of the coolant outside of the cooling unit.

4. The image forming apparatus of claim 2, wherein piping supplies the coolant from the collection part to the spray part.

5. The image forming apparatus of claim 4, wherein a portion of the piping passes through the cooler.

6. The image forming apparatus of claim 2, wherein the cooler includes a refrigerating cycle having a compressor, a condenser, and a vaporizer.

7. The image forming apparatus of claim 2, wherein a removing blade is disposed to contact the backside of the intermediate transfer medium to remove the coolant attached on the backside thereof.

8. The image forming apparatus of claim 2, wherein a temperature sensor senses a temperature of the coolant; and a cooling controller operates the cooling unit when the coolant temperature sensed by the temperature sensor is over the predetermined temperature.

9. The image forming apparatus of claim 1, wherein a dry unit is disposed between the photosensitive medium and the transferring and fusing unit to dry the image formed on the intermediate transfer medium.

10. An image forming apparatus, comprising:

a photosensitive medium on which an image is formed;

an intermediate transfer medium disposed to contact the photosensitive medium and to rotate in a closed loop, and onto which the image formed on the photosensitive medium is transferred;

a transferring and fusing unit disposed to contact the intermediate transfer medium to transfer the image formed on the intermediate transfer medium onto a printing paper and to fuse the transferred image onto the printing paper;

a cooling unit disposed to contact a backside of the intermediate transfer medium and having a cooling member through which coolant circulates to cool the intermediate transfer medium, the cooling unit including a cooler to cool the coolant to a predetermined temperature, the cooler including a refrigerating cycle having a compressor, a condenser and a vaporizer; and a circulating pump to circulate the coolant through the cooling member.

11. The image forming apparatus of claim 10, wherein a temperature sensor senses a temperature of the coolant; and a cooling controller operates the cooling unit when the coolant temperature sensed by the temperature sensor is over the predetermined temperature.

12. The image forming apparatus of claim 10, wherein a dry unit is disposed between the photosensitive medium and the transferring and fusing unit to dry the image formed on the intermediate transfer medium.

13. The image forming apparatus of claim 10, wherein piping supplies the coolant from the cooling unit to the circulating pump.

14. The image forming apparatus of claim 13, wherein a portion of the piping passes through the cooler.

15. A method of cooling a photosensitive medium, comprising the steps of disposing a cooling unit within an intermediate transfer medium;

passing a backside of the intermediate transfer medium proximal the cooling unit to cool the intermediate transfer medium; and spraying a coolant onto the backside of the intermediate transfer medium as the intermediate transfer medium passes proximal the cooling unit to cool the intermediate transfer medium.

16. A method of cooling a photosensitive medium according to claim 15, further comprising sensing a temperature of the coolant stored in the cooling unit;

transmitting the sensed temperature to a controller; and cooling the coolant if the sensed temperature is above a predetermined temperature.

17. A method of cooling a photosensitive medium according to claim 15, further comprising circulating coolant through the cooling unit to cool the intermediate transfer medium passing proximal the cooling unit.

* * * * *